US010757770B2

(12) United States Patent
Kuo

(10) Patent No.: US 10,757,770 B2
(45) Date of Patent: Aug. 25, 2020

(54) LIGHT SOURCE DRIVING CIRCUITS AND LIGHT SOURCE MODULE

(71) Applicant: O2Micro, Inc., Santa Clara, CA (US)

(72) Inventor: Ching Chuan Kuo, Taipei (TW)

(73) Assignee: O2Micro Inc, Santa Clara, CA (US)

( * ) Notice: Subject to any disclaimer, the term of this patent is extended or adjusted under 35 U.S.C. 154(b) by 0 days.

(21) Appl. No.: 15/043,435

(22) Filed: Feb. 12, 2016

(65) Prior Publication Data

US 2020/0084851 A1 Mar. 12, 2020

(51) Int. Cl.

| | |
|---|---|
| ***H05B 45/10*** | (2020.01) |
| ***F21V 23/04*** | (2006.01) |
| ***F21V 23/02*** | (2006.01) |
| ***F21V 23/00*** | (2015.01) |
| ***H05B 45/20*** | (2020.01) |

(52) U.S. Cl.

CPC ..... *H05B 45/10* (2020.01); *F21V 23/003* (2013.01); *F21V 23/02* (2013.01); *F21V 23/04* (2013.01); *H05B 45/20* (2020.01)

(58) Field of Classification Search

CPC ..... H05B 37/02; H05B 33/08; H05B 45/10; H05B 45/14; H05B 45/20; H05B 45/24; H05B 45/30; H05B 45/305; H05B 45/31; H05B 45/325; F21V 23/003; F21V 23/02; F21V 23/04

See application file for complete search history.

(56) References Cited

U.S. PATENT DOCUMENTS

| | | | | |
|---|---|---|---|---|
| 7,256,554 | B2 * | 8/2007 | Lys | H05B 45/3725 315/291 |
| 8,076,867 | B2 | 12/2011 | Kuo et al. | |
| 8,288,969 | B2 * | 10/2012 | Hsu | H05B 45/46 315/360 |
| 8,339,063 | B2 | 12/2012 | Yan et al. | |
| 8,456,109 | B1 * | 6/2013 | Wray | H05B 45/44 315/307 |
| 8,604,699 | B2 * | 12/2013 | Kotowski | H05B 45/37 315/122 |
| 9,699,850 | B1 * | 7/2017 | Jin | H05B 45/46 |
| 9,844,113 | B2 | 12/2017 | Yan et al. | |
| 2012/0038292 | A1 * | 2/2012 | Kuo | H05B 45/37 315/297 |

(Continued)

FOREIGN PATENT DOCUMENTS

| | | |
|---|---|---|
| CN | 101854759 A | 10/2010 |
| CN | 102014540 A | 4/2011 |

(Continued)

*Primary Examiner* — Jason Crawford

(57) ABSTRACT

A light source driving circuit includes a rectifier operable for rectifying a voltage from a power source and providing a rectified voltage, a power converter coupled to the rectifier and operable for receiving the rectified voltage and providing an output current, and a light source module coupled to the power converter and powered by the output current. The light source module includes a first light source having a first color, a second light source having a second color, and a current allocation unit coupled to the first light source and the second light source. The current allocation unit is operable for adjusting a current through the first light source and a current through the second light source based on the output current.

21 Claims, 9 Drawing Sheets

(56) References Cited

U.S. PATENT DOCUMENTS

| | | | | |
|---|---|---|---|---|
| 2013/0069546 | A1* | 3/2013 | Lin | H05B 45/44<br>315/186 |
| 2013/0229119 | A1* | 9/2013 | Korobov | H05B 45/37<br>315/185 R |
| 2013/0328498 | A1* | 12/2013 | Yan | H05B 47/10<br>315/224 |
| 2014/0091723 | A1* | 4/2014 | Kuo | H05B 45/14<br>315/200 R |
| 2014/0210357 | A1* | 7/2014 | Yan | H05B 45/46<br>315/186 |
| 2015/0271884 | A1* | 9/2015 | Kim | H05B 45/10<br>315/153 |

FOREIGN PATENT DOCUMENTS

| | | | |
|---|---|---|---|
| CN | 103347334 | A | 10/2013 |
| CN | 103415111 | A | 11/2013 |
| CN | 103974503 | A | 8/2014 |

* cited by examiner

LIGHT SOURCE DRIVING CIRCUITS AND LIGHT SOURCE MODULE

RELATED APPLICATIONS

This application is a continuation-in-part of U.S. patent application Ser. No. 14/960,195, titled "Light Source Driving Circuits for TRIAC Dimmer," filed on Dec. 4, 2015, which itself claims priority to Chinese Patent Application No. 201410731506.X, titled "Light Source Driving Circuits for TRIAC Dimmer," filed on Dec. 4, 2014, with the State Intellectual Property Office of the People's Republic of China. This application also claims priority to Chinese Patent Application No. 201510082437.9, titled "Light Source Driving Circuits and Light Source Module," filed on Feb. 13, 2015, with the State Intellectual Property Office of the People's Republic of China.

BACKGROUND

LEDs offer several advantages over traditional light sources such as incandescent lamps. For example, LEDs have low power consumption, high power efficiency and long life. Therefore, there is a trend to replace incandescent lamps with LEDs. LED bulbs have similar shapes and sizes as those of incandescent bulbs. LED light sources and control circuitry are integrated within an LED bulb. Using a conventional on/off switch, a user can only control the on/off or brightness level of an LED bulb, but cannot adjust the color of the light. In order to adjust the color, a special dimmer or a remote controller is needed.

SUMMARY

Embodiments in accordance with the present invention provide circuits for driving light source modules, e.g., light source modules including light-emitting diodes (LED).

In one embodiment, a light source driving circuit includes a rectifier operable for rectifying a voltage from a power source and providing a rectified voltage, a power converter coupled to the rectifier and operable for receiving the rectified voltage and providing an output current, and a light source module coupled to the power converter and powered by the output current. The light source module includes a first light source having a first color, a second light source having a second color, and a current allocation unit coupled to the first light source and the second light source. The current allocation unit is operable for adjusting a current through the first light source and a current through the second light source based on the output current.

In another embodiment, a light source module includes a first light source having a first color, a second light source having a second color, and a current allocation unit coupled to the first light source and the second light source. The current allocation unit is operable for adjusting a current through the first light source and a current through the second light source based on an input current of the light source module.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
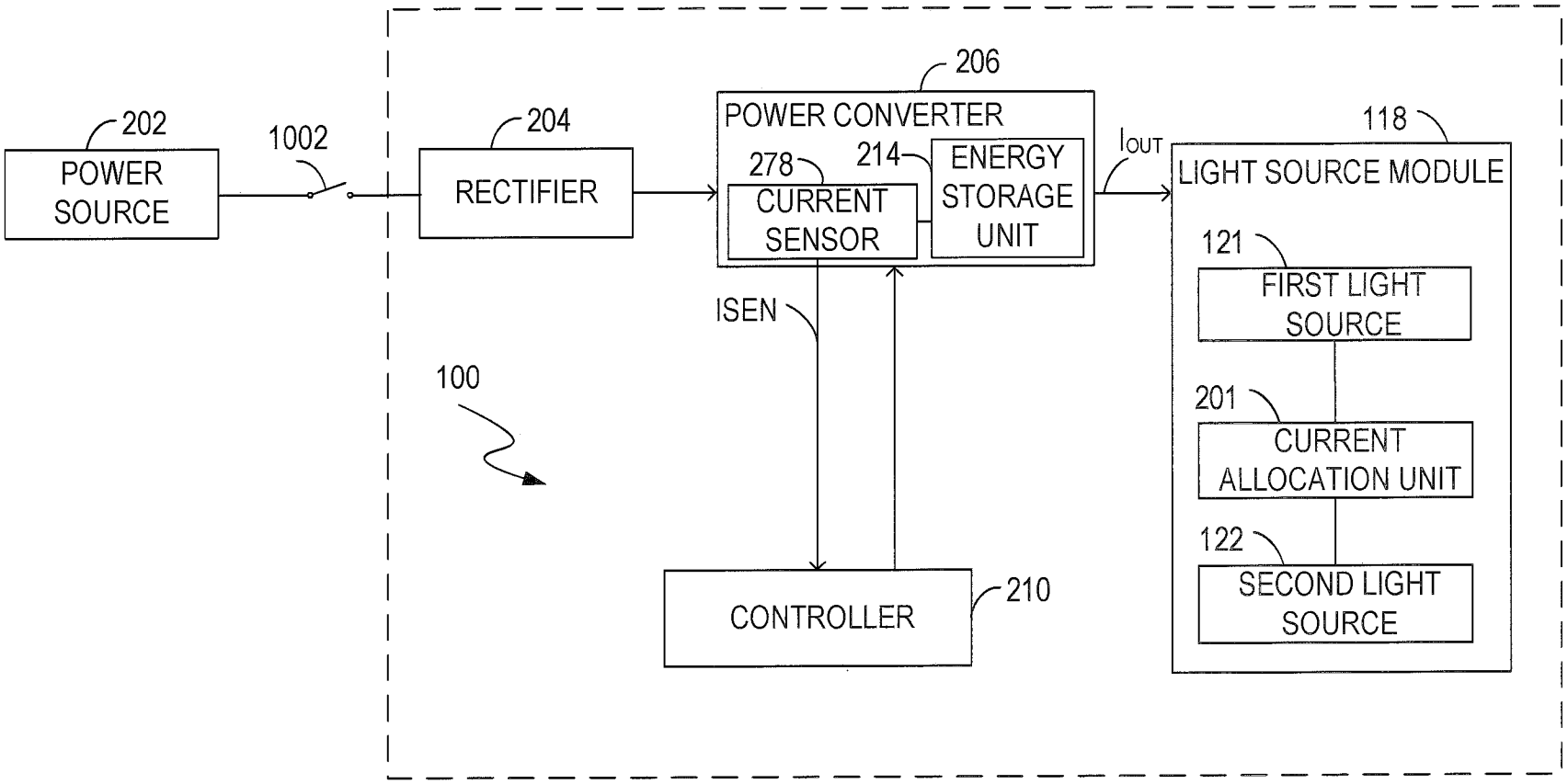
FIG. 1 shows a light source driving circuit, in accordance with one embodiment of the present invention.

FIG. 1 shows a light source driving circuit 100, in accordance with one embodiment of the present invention. In the example of FIG. 1, the light source driving circuit 100 include a rectifier 204 coupled to a power source 202 through a power switch 1002 for receiving a voltage from the power source 202 and for providing a rectified voltage for a power converter 206. The power converter 206 receives the rectified voltage and provides an output current to a load, e.g., a light source module 118. The power converter 206 can be a buck converter or a boost converter. In one embodiment, the power converter 206 includes an energy storage unit 214 and a current sensor 278 (e.g., a resistor) for monitoring a status of the energy storage unit 214. The current sensor 278 provides a first signal ISEN to the controller 210. The first signal ISEN indicates an instant current flowing through the energy storage unit 214. The controller 210 receives and filters (e.g., by a filter shown in FIG. 3) the first signal ISEN to generate a second signal IAVG which indicates an average current through the energy storage unit 214. The controller 210 controls the average current through the energy storage unit 214 (i.e., the output current $I_{OUT}$ of the power converter 206, which is also the input current of the light source module 118) to be equal with a target current level. The light source module 118 includes a first light source 121 and a second light source 122. The first light source 121 can be a first LED string LED1 having a first color (e.g., a warm light LED string). The second light source 122 can be a second LED string LED2 having a second color (e.g., a cold light LED string). The light source module 118 further includes a current allocation unit 201 coupled to the first light source 121 and the second light source 122 for regulating a current through the first light source 121 and a current through the second light source 122 based on the output current lour of the power converter 206.

Figure 2:
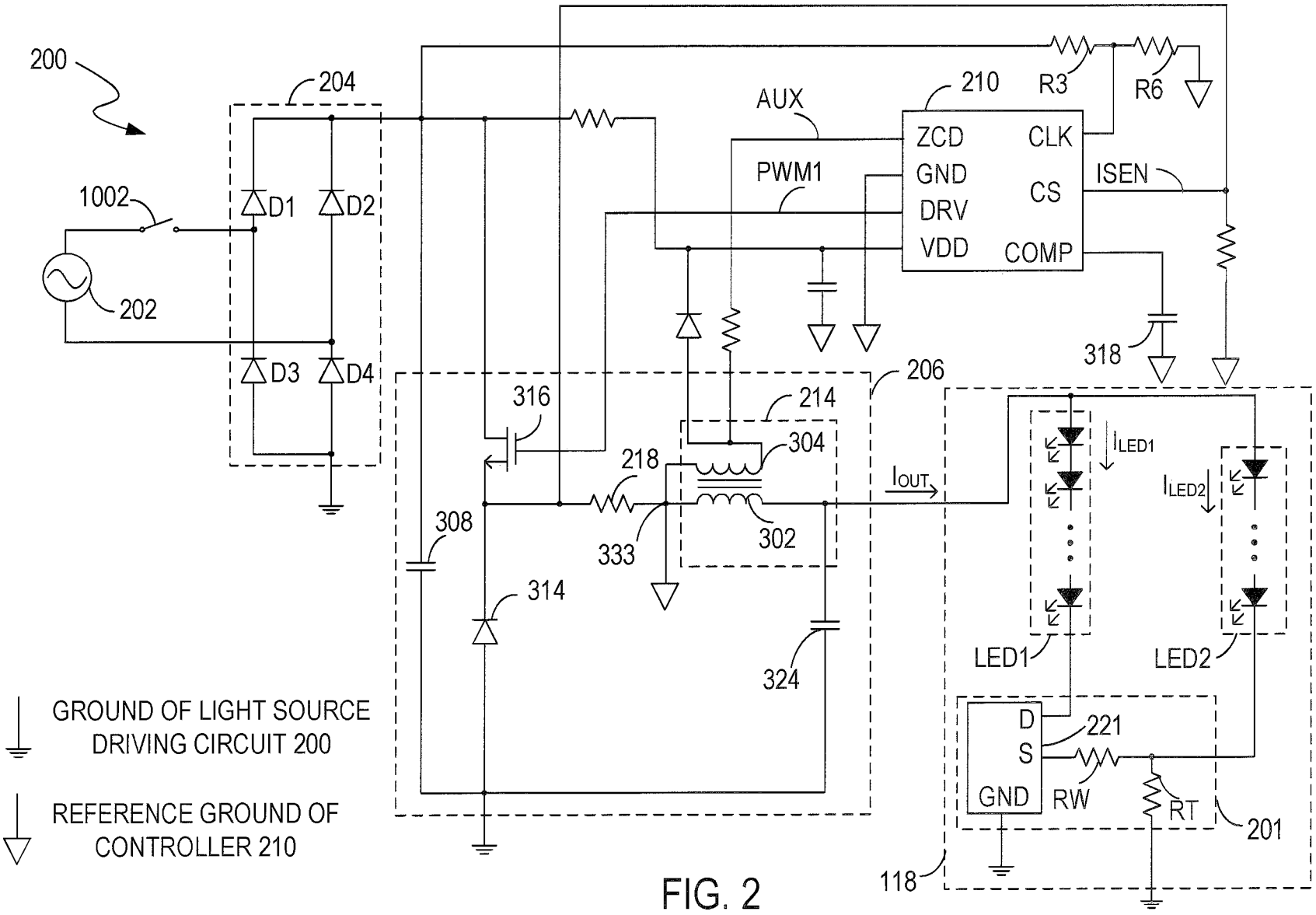
FIG. 2 shows a light source driving circuit, in accordance with one embodiment of the present invention.

FIG. 2 shows a light source driving circuit 200, in accordance with one embodiment of the present invention. Elements labeled the same as in FIG. 1 have similar functions. In the example of FIG. 2, the light source driving circuit 200 includes a rectifier 204, a power converter 206, a controller 210 and a light source module 118. The rectifier 204 can be a bridge rectifier including diodes D1~D4. The rectifier 204 is coupled to the power source 202 through a power switch 1002 and rectifies a voltage from the power source 202. The power converter 206 receives the rectified voltage from the rectifier 204 and provides an output current $I_{OUT}$ for powering a load (e.g., a light source module 118). In one embodiment, the power switch 1002 can be a conventional on/off switch mounted on the wall.

In the example of FIG. 2, the power converter 206 is a buck converter which includes a capacitor 308, a first switch 316, a diode 314, a current sensor (e.g., a resistor 218), an energy storage unit 214 including an inductor 302 and an inductor 304 which are electrically and magnetically coupled together, and a capacitor 324. The diode 314 is coupled between the switch 316 and the ground of the light source driving circuit 200. The capacitor 324 is coupled in parallel with the light source module 118.

The inductor 302 and the inductor 304 are electrically coupled to a common node 333. In the example of FIG. 2, the common node 333 is between the resistor 218 and the inductor 302. However, the invention is not so limited; the common node 333 can also locate between the switch 316 and the resistor 218. The common node 333 provides a reference ground for the controller 210. The reference ground of the controller 210 is different from the ground of the driving circuit 200, in one embodiment. By turning the switch 316 on and off, a current flowing through the inductor 302 can be adjusted, thereby adjusting the output current $I_{OUT}$ from the power converter 206. The inductor 304 senses an electrical condition of the inductor 302, for example, whether the current flowing through the inductor 302 decreases to a predetermined current level.

The resistor 218 has one end coupled to a node between the switch 316 and the cathode of the diode 314, and the other end coupled to the inductor 302. The resistor 218 provides a first signal ISEN indicating an instant current flowing through the inductor 302 when the switch 316 is on and also when the switch 316 is off. In other words, the resistor 218 can sense the instant current flowing through the inductor 302 regardless of whether the switch 316 is on or off.

The controller 210 receives the first signal ISEN, and controls an average current flowing through the inductor 302 to a target current level by turning the switch 316 on and off. A capacitor 324 absorbs ripples of the output current $I_{OUT}$ such that the input current of the light source module 118 is smoothed and substantially equal to the average current flowing through the inductor 302. As such, the input current of the light source module 118 can have a level that is substantially equal to the target current level. As used herein, "substantially equal to the target current level" means that the input current of the light source module 118 may be slightly different from the target current level but within a range such that the current ripple caused by the non-ideality of the circuit components can be neglected and the power transferred from the inductor 304 to the controller 210 can be neglected.

In the example of FIG. 2, the controller 210 has terminals ZCD, GND, DRV, VDD, CS, COMP and CLK. The terminal ZCD is coupled to the inductor 304 for receiving a detection signal AUX indicating an electrical condition of the inductor 302, for example, whether the current flowing through the inductor 302 decreases to a predetermined current level, e.g., zero. The terminal DRV is coupled to the switch 316 and generates a driving signal, e.g., a pulse-width modulation signal PWM1, to turn the switch 316 on and off. The terminal VDD is coupled to the inductor 304 for receiving power from the inductor 304. The terminal CS is coupled to the resistor 218 and is operable for receiving the first signal ISEN indicating an instant current flowing through the inductor 302. The terminal COMP is coupled to the reference ground of the controller 210 through a capacitor 318. The terminal CLK is coupled to the rectifier 204 through a resistor R3 and coupled to ground through a resistor R6. In other words, the terminal CLK is coupled to the power switch 1002 through a voltage divider including the resistors R3 and R6 and through the rectifier 204. The terminal CLK is operable for monitoring operations of the power switch 1002. In one embodiment, the controller 210 receives a dimming request signal and a dimming termination signal via the terminal CLK. The dimming request signal can indicate a first set of operations of the power switch 1002. The dimming termination signal can indicate a second set of operations of the power switch 1002. The controller 210 adjusts the output current $I_{OUT}$ based on the dimming request signal and the dimming termination signal. More specifically, the controller 210 continuously adjusts the output current $I_{OUT}$ in response to the dimming request signal, and stops adjusting the output current $I_{OUT}$ in response to the dimming termination signal. In the example of FIG. 2, the terminal GND, that is, the reference ground for the controller 210, is coupled to the common node 333.

The switch 316 can be an N channel metal oxide semiconductor field effect transistor (NMOSFET). The conductance status of the switch 316 is determined based on a difference between the gate voltage of the switch 316 and the voltage at the terminal GND (i.e., the voltage at the common node 333). Therefore, the switch 316 is turned on and turned off depending upon the pulse-width modulation signal PWM1 from the terminal DRV. When the switch 316 is on, the reference ground of the controller 210 is higher than the ground of the driving circuit 200, making the invention suitable for power sources having relatively high voltages.

In operation, when the switch 316 is turned on, a current flows through the switch 316, the resistor 218, the inductor 302, the light source module 118 to the ground of the driving circuit 200. When the switch 316 is turned off, a current continues to flow through the resistor 218, the inductor 302, the light source module 118 and the diode 314. The inductor 304 magnetically coupled to the inductor 302 detects whether the current flowing through the inductor 302 decreases to a predetermined current level. Therefore, the controller 210 monitors the current flowing through the inductor 302 through the signal AUX and the signal ISEN, and control the switch 316 by a pulse-width modulation signal PWM1 so as to control an average current flowing through the inductor 302 to a target current level, in one embodiment. As such, the output current $I_{OUT}$ from the power converter 206, which is filtered by the capacitor 324, can also be substantially equal to the target current level.

Figure 3:
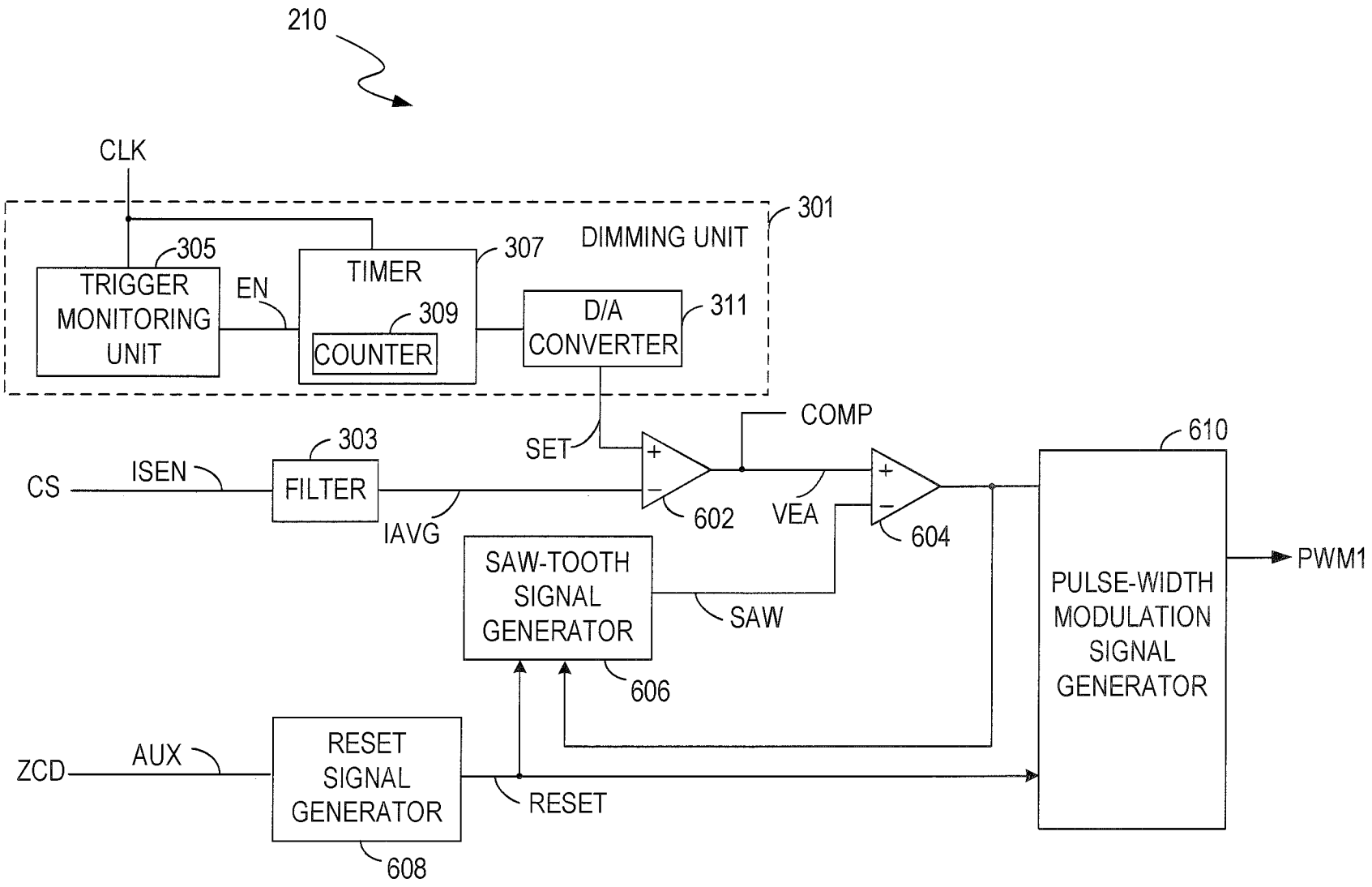
FIG. 3 shows a bock diagram of the controller in FIG. 2, in accordance with one embodiment of the present invention.
Figure 4:
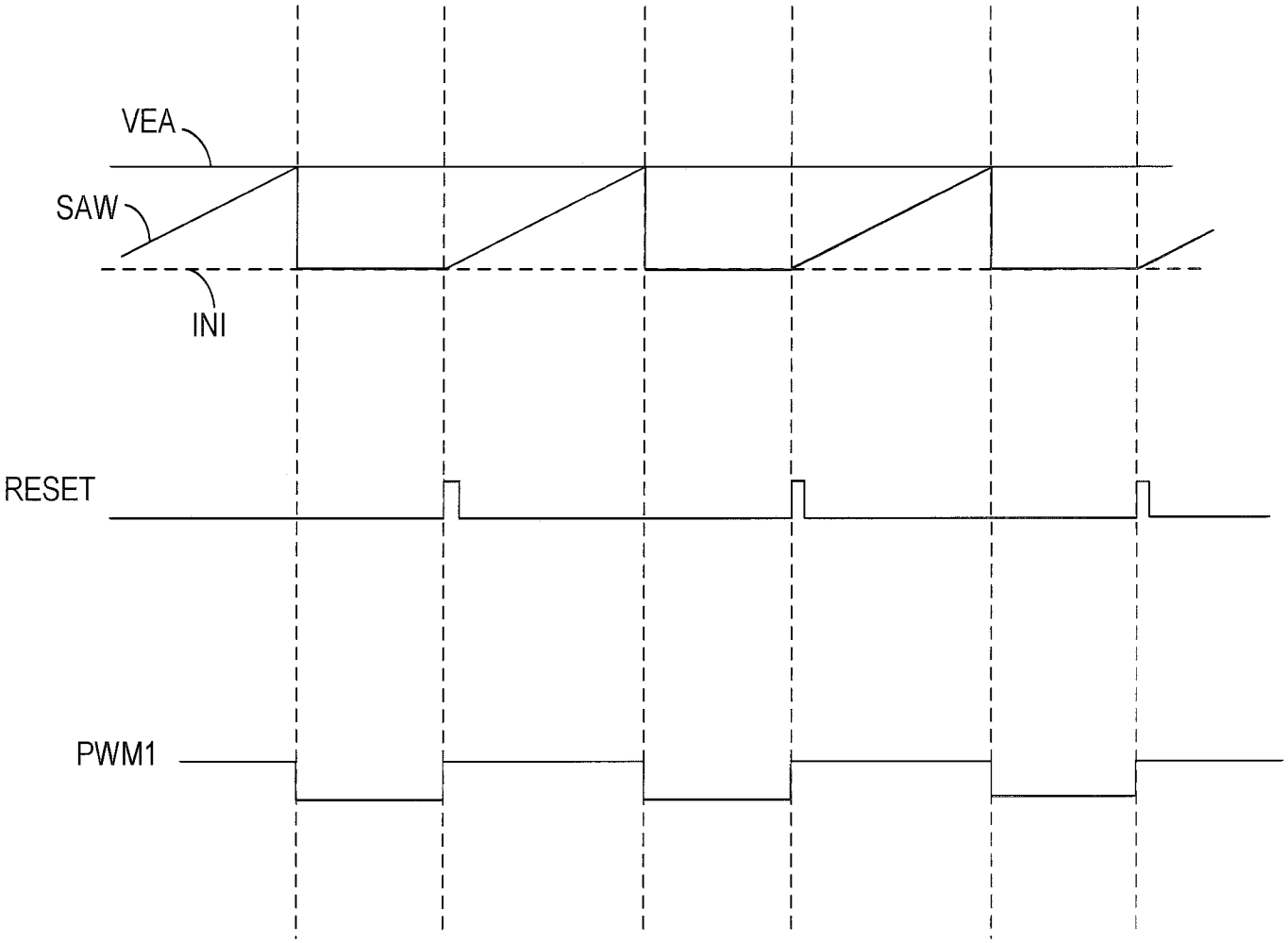
FIG. 4 shows waveforms associated with the controller in FIG. 2, in accordance with one embodiment of the present invention.

FIG. 3 shows a bock diagram of the controller 210 in FIG. 2, in accordance with one embodiment of the present invention. FIG. 4 shows waveforms associated with the controller 210 in FIG. 2, in accordance with one embodiment of the present invention. FIG. 3 is described in combination with FIG. 2 and FIG. 4.

In the example of FIG. 3, the controller 210 includes a dimming unit 301, a filter 303, an error amplifier 602, a comparator 604, a saw-tooth signal generator 606, a reset signal generator 608 and a pulse-width modulation signal generator 610. The dimming unit 301 monitors operations of the power switch 1002 in FIG. 2, receives the dimming request signal and the dimming termination signal via the terminal CLK, and generates a dimming signal SET. The dimming request signal indicates a first set of operations of the power switch 1002. The dimming termination signal indicates a second set of operations of the power switch 1002. The dimming signal SET indicates a target current level of the average current flowing through the inductor 302. The filter 303 filters the first signal ISEN and provides a second signal IAVG indicating the average current flowing through the inductor 302. In the example of FIG. 3, the filter 303 is integrated within the controller 210. In another embodiment, the filter can be outside of the controller 210. The error amplifier 602 generates an error signal VEA based on a difference between a dimming signal SET and the second signal IAVG. The error signal VEA can be used to adjust the average current flowing through the inductor 302 to the target current level. The saw-tooth signal generator 606 generates a saw-tooth signal SAW. The comparator 604 is coupled to the error amplifier 602 and the saw-tooth signal generator 606, and compares the error signal VEA with the saw-tooth signal SAW. The reset signal generator 608 is coupled to the terminal ZCD and generates a reset signal RESET based on the signal AUX received at the terminal ZCD. The reset signal RESET is applied to the saw-tooth signal generator 606 and the pulse-width modulation signal generator 610. The switch 316 can be turned on in response to the reset signal RESET. The signal AUX indicates whether the current flowing through the inductor 302 decreases to a predetermined current level, e.g., zero. The pulse-width modulation signal generator 610 is coupled to the comparator 604 and the reset signal generator 608, and can generate a pulse-width modulation signal PWM1 based on an output of the comparator 604 and the reset signal RESET. The pulse-width modulation signal PWM1 is applied to the switch 316 via the terminal DRV to control a conductance status of the switch 316.

When the switch 316 is turned on, a current flows through the switch 316, the resistor 218, the inductor 302, the light source module 118 to the ground of the light source driving circuit 200. The signal AUX has a negative voltage level when the switch 316 is turned on, in one embodiment. The voltage of the signal AUX changes to a positive voltage level when the switch 316 is turned off. When the switch 316 is turned off, a current flows through the resistor 218, the inductor 302, the light source module 118 and the diode 314. The current flowing through the inductor 302 decreases. When the current flowing through the inductor 302 decreases to a predetermined current level (e.g., zero), a negative-going edge occurs to the voltage of the signal AUX. Receiving a negative-going edge of the signal AUX, the reset signal generator 608 generates a pulse in the reset signal RESET. In response to the pulse of the reset signal RESET, the pulse-width modulation signal generator 610 generates the pulse-width modulation signal PWM1 having a first level (e.g., logic 1) to turn on the switch 316. In response to the pulse of the reset signal RESET, the saw-tooth signal SAW generated by the saw-tooth signal generator 606 starts to increase from an initial level INI. When the voltage of the saw-tooth signal SAW increases to the voltage of the error signal VEA, the pulse-width modulation signal generator 610 generates the pulse-width modulation signal PWM1 having a second level (e.g., logic 0) to turn off the switch 316. The saw-tooth signal SAW is reset to the initial level INI until a next pulse of the reset signal RESET is received by the saw-tooth signal generator 606. The saw-tooth signal SAW starts to increase from the initial level INI again in response to the next pulse.

In one embodiment, a duty cycle of the pulse-width modulation signal PWM1 is determined by the error signal VEA. If the voltage of the second signal IAVG is less than the voltage of the dimming signal SET, the error amplifier 602 increases the voltage of the error signal VEA so as to increase the duty cycle of the pulse-width modulation signal PWM1. Accordingly, the average current flowing through the inductor 302 increases until the voltage of the second signal IAVG increases to the voltage of the signal SET. If the voltage of the second signal IAVG is greater than the voltage of the dimming signal SET, the error amplifier 602 decreases the voltage of the error signal VEA so as to decrease the duty cycle of the pulse-width modulation signal PWM1. Accordingly, the average current flowing through the inductor 302 decreases until the voltage of the second signal IAVG decreases to the voltage of the dimming signal SET. As such, the average current flowing through the inductor 302 can be maintained to be substantially equal to the target current level.

Figure 5:
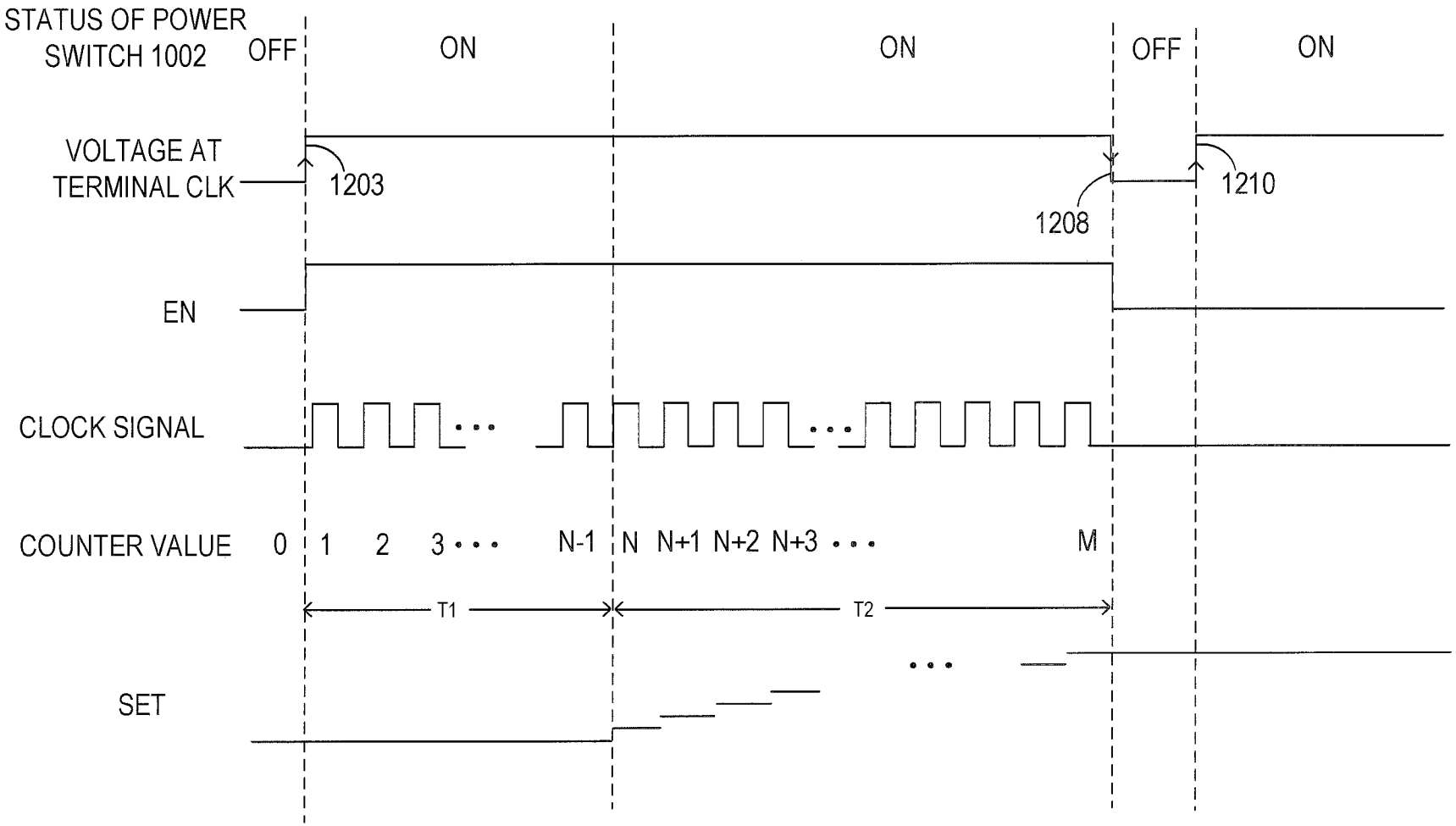
FIG. 5 shows waveforms associated with the light source driving circuit in FIG. 2, in accordance with one embodiment of the present invention.

FIG. 5 shows waveforms associated with the light source driving circuit 200 in FIG. 2, in accordance with one embodiment of the present invention. The operation of the dimming unit 301 in FIG. 3 is described in combination with FIG. 5. The dimming unit 301 includes a trigger monitoring unit 305, a timer 307 and a D/A converter 311. In one embodiment, the timer 307 includes a counter 309. The trigger monitoring unit 305 receives the dimming request signal and the dimming termination signal via the terminal CLK, and generates an enable signal EN based on the dimming request signal and the dimming termination signal to enable or disable the timer 307. The timer 307 measures time under control of the enable signal EN. The D/A converter 311 generates the dimming signal SET based on the output of the timer 307 to adjust the output current $I_{OUT}$ from the power converter 206. The dimming request signal can indicate a first set of operations of the power switch 1002. The dimming termination signal can indicate a second set of operations of the power switch 1002. The dimming unit 301 continuously adjusts the dimming signal SET in response to the dimming request signal, and stops adjusting the dimming signal SET in response to the dimming termination signal. In other words, upon detection of the first set of operations of the power switch 1002, the controller 210 continuously adjusts the output current $I_{OUT}$. Upon detection of the second set of operations of the power switch 1002, the controller 210 stops adjusting the output current $I_{OUT}$. In one embodiment, the first set of operations of the power switch 1002 includes a first turn-on operation. In one embodiment, the second set of operations of the power switch 1002 includes a first turn-off operation followed by a second turn-on operation.

Assume that the power switch 1002 is initially turned off. When the power switch 1002 is turned on by a user, the power converter 206 powers the light source module 118. The output current $I_{OUT}$ from the power converter 206 is determined by an initial value of the dimming signal SET. When the power switch 1002 is turned on, the trigger monitoring unit 305 receives the dimming request signal at the terminal CLK. In one embodiment, a positive-going edge 1203 (shown in FIG. 5) detected at terminal CLK indicates that the trigger monitoring unit 305 receives the dimming request signal. In response to the dimming request signal, the trigger monitoring unit 305 generates an enable signal having a HIGH level to enable the timer 307 to start timing. In the example of FIG. 3, the counter 309 in the timer 307, driven by a clock signal, starts counting. The counter value increases gradually from 0 to N. N is an integer greater than or equal to 1. In one embodiment, the controller 210 maintains the output current $I_{OUT}$ unchanged during a predetermined time period after receiving the dimming request signal and before adjusting the output current $I_{OUT}$. For example, during the time period T1 (the time period before the counter value of the counter 309 increases to N), the D/A converter 311 maintains the dimming signal SET at the initial value such that the output current lour remains unchanged. If the counter value reaches N, the converter 311 continuously increases the dimming signal SET in response to the increment of the counter value. As a result, the output current $I_{OUT}$ and the brightness of the light source module 118 are increased.

If the brightness of the light source module 118 reaches a desired level, the user can apply a second set of operations to the power switch 1002 to terminate the brightness change of the light source module 118. The dimming termination signal is generated in response to the second set of operations. In one embodiment, the second set of operations of the power switch 1002 includes a first turn-off operation followed by a second turn-on operation. The trigger monitoring unit 305 receives the dimming termination signal at the terminal CLK. In one embodiment, a negative-going edge 1208 followed by a positive-going edge 1210 (shown in FIG. 5) detected at terminal CLK indicates that the trigger monitoring unit 305 receives the dimming termination signal. In response to the dimming termination signal, the trigger monitoring unit 305 generates an enable signal EN having a LOW level to disable the timer 307 such that the counter 309 maintains the counter value (e.g., M) unchanged, and the D/A converter 311 maintains the dimming signal SET unchanged. Accordingly, the output current $I_{OUT}$ and the brightness of the light source module 118 are maintained unchanged.

Therefore, during the time period T1 (the time period during which the counter value of the counter 309 increases from 0 to N−1), the output current $I_{OUT}$ from power converter 206 is maintained at the initial value. During the time period T2 (the time period during which the counter value of the counter 309 increases from N to M), the output current $I_{OUT}$ from power converter 206 increases and the brightness of the light source module 118 increase. After the time period T2, in response to the dimming termination signal, the output current lour from the power converter 206 and the brightness of the light source module 118 are locked. In one embodiment, N is equal to 1 such that the duration of the time period T1 is 0. In this situation, the controller 210 immediately starts to continuously adjust the output current $I_{OUT}$ in response to the dimming request signal.

During a time period after the power switch 1002 is turned off, the controller 210 can be powered by a capacitor coupled to the terminal VDD. In one embodiment, if a time interval between the first turn-off operation and the second turn-on operation in the second sets of operation of the power switch 1002 is greater than a threshold, the counter value of the counter 309 is reset to 0. Accordingly, after the second turn-on operation, the output current $I_{OUT}$ is restored to the initial value.

Figure 6:
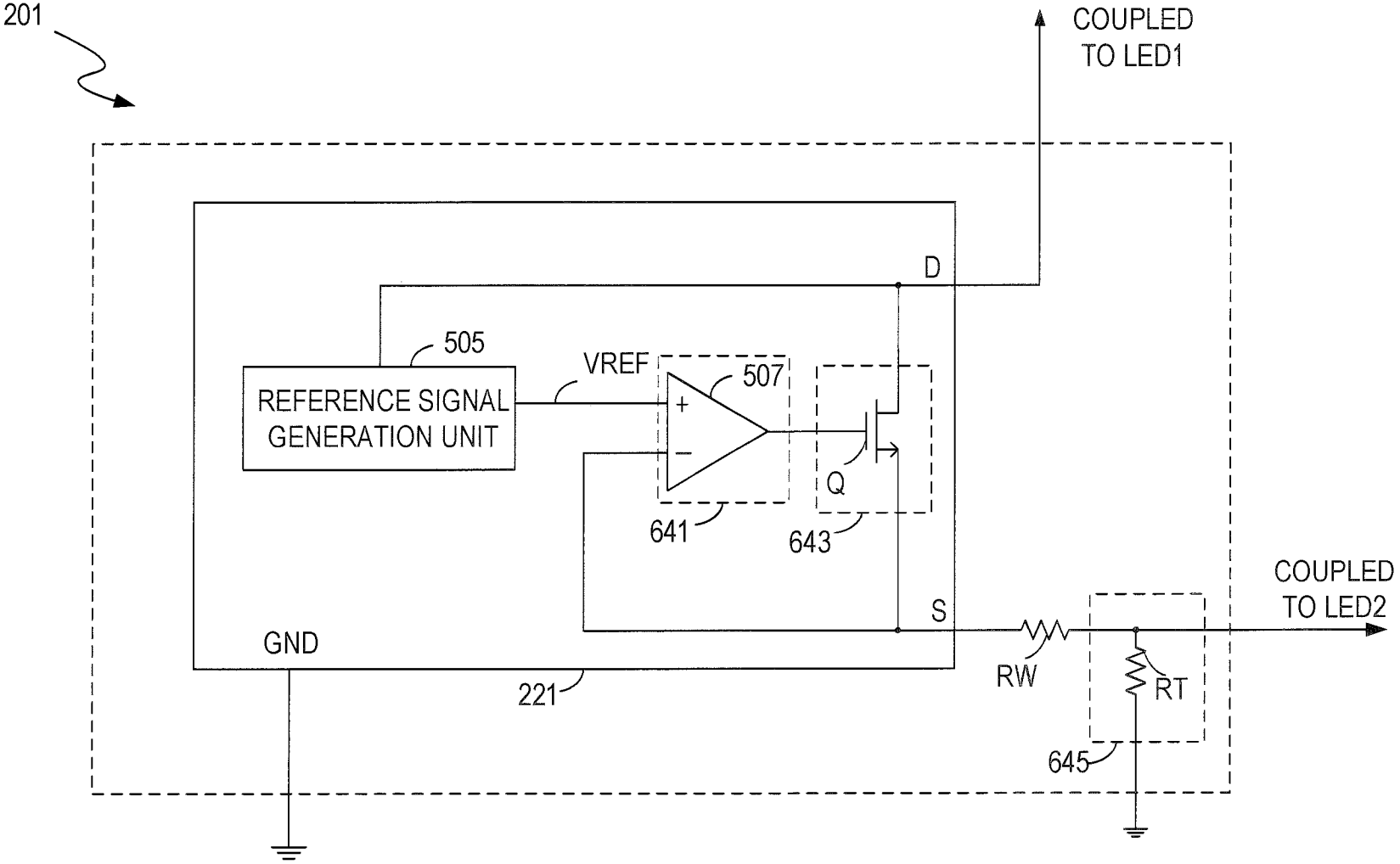
FIG. 6 shows a block diagram of the current allocation unit in FIG. 2, in accordance with one embodiment of the present invention.
Figure 7:
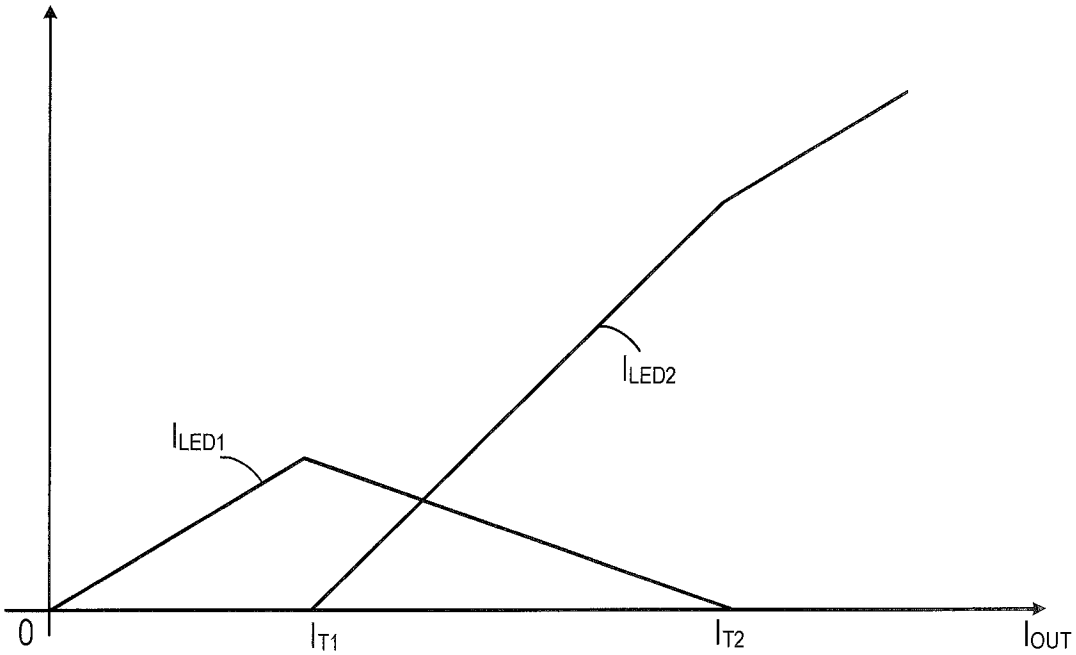
FIG. 7 shows current waveforms of the first light source and the second light source in FIG. 2, in accordance with one embodiment of the present invention.

FIG. 6 shows a block diagram of the current allocation unit 201 in FIG. 2, in accordance with one embodiment of the present invention. FIG. 7 shows the relation among the current of the first LED string LED1, current of the second LED string LED2 and the output current $I_{OUT}$ from the power converter 206, in accordance with one embodiment of the present invention. FIG. 6 is described in combination with FIG. 7.

The current allocation unit 201 includes a sensing unit 645 coupled to the LED strings LED1 and LED2, a control unit 641 coupled to the sensing unit 645 and a current regulation unit 643 coupled to the LED string LED1. The sensing unit 645 provides a sensing signal indicating the output current $I_{OUT}$. The control unit 641 controls the current regulation unit 643 based on the output current $I_{OUT}$ to regulate the current $I_{LED1}$ through the LED string LED1 In the examples in FIG. 2 and FIG. 6, the sensing unit 645 includes a resistor RT coupled to the LED strings LED1 and LED2. A voltage $V_T$ across the resistor RT is the sensing signal which indicates the output current $I_{OUT}$. The control unit 641 includes an operational amplifier 507. The current regulation unit 643 includes a second switch (e.g., a transistor Q) coupled to the LED string LED1 in series. A non-inverting terminal of the operational amplifier 507 receives a reference signal VREF from a reference signal generation unit 505. An inverting terminal of the operational amplifier 507 is coupled to the resistor RT through a resistor RW. An output terminal of the operational amplifier 507 is coupled to the transistor Q. The operational amplifier 507 regulates the current $I_{LED1}$ through the LED string LED1 by controlling the transistor Q. Because the current $I_{LED2}$ through the LED string LED2 is equal to $I_{OUT}$ minus $I_{LED1}$, by adjusting $I_{LED1}$ the allocation of the current through the LED strings LED1 and LED2 can be adjusted, and thus the current $I_{LED2}$ through the LED string LED2 can be adjusted. In one embodiment, the reference signal generation unit 505, the operational amplifier 507 and the transistor Q is integrated in a chip 221.

If the power switch 1002 is turned on, the output current $I_{OUT}$ from the power converter 206 flows to the light source module 118. An initial voltage at the terminal S of the chip 221, which is connected to the resistor RW, is less than the reference signal VREF generated by the reference signal generation unit 505. The operational amplifier 507 fully turns on the transistor Q. Assume that the output current $I_{OUT}$ increases from 0. The relation among the current $I_{LED1}$ of the LED string LED1, the current $I_{LED2}$ of the LED string LED2 and the output current $I_{OUT}$ is described below. In one embodiment, the light source driving circuit 200 is configured in such a way that the forward voltage of the LED string LED1 is less than the forward voltage of the LED string LED2. When the voltage across the LED string LED1 increases to its forward voltage, the LED string LED1 is turned on, while the LED string LED2 is still off. A current flows through the LED string LED1, the resistor RW and the resistor RT to ground. The current $I_{LED1}$ flowing through the LED string LED1 increases with the output current $I_{OUT}$, the voltage $V_S$ at the terminal S also increases accordingly. On the other hand, with the increment of the output current $I_{OUT}$, the voltage across the LED string LED2 reaches its forward voltage and the LED string LED2 is also turned on. When the output current $I_{OUT}$ increases to $I_{T1}$, the voltage $V_S$ at the terminal S increases to a value approaching the voltage of the reference signal VREF such that the transistor Q enters the active region. The operational amplifier 507 controls the transistor Q to linearly regulates the current $I_{LED1}$ flowing through the LED string LED1 such that the voltages of the two input terminals of the operational amplifier 507 tend to be equal with each other.

Therefore, in an ideal situation, when the transistor Q operates in the active region, the relation between the voltage $V_S$ at the terminal S and the reference signal VREF can be written by:

$$V_S = V_{REF} \tag{1}$$

where $V_{REF}$ is the voltage of the reference signal VREF.

Because the total current of the LED strings LED1 and LED2 (i.e., output current $I_{OUT}$) flows through the resistor RT to ground, the voltage $V_T$ across the resistor RT can be given by:

$$V_T = I_{OUT} \times R_T \tag{2}$$

where $R_T$ is the resistance of the resistor RT.

The resistor RW is coupled in series with the LED string LED1, and the current $I_{LED1}$ flowing through the LED string LED1 can be given by:

$$I_{LED1} = \frac{V_S - V_T}{R_W} = \frac{V_{REF} - I_{OUT} \times R_T}{R_W} \tag{3}$$

where $R_W$ is the resistance of the resistor RW.

The current $I_{LED2}$ flowing through the LED string LED2 can be given by:

$$I_{LED2} = I_{OUT} - I_{LED1} \tag{4}$$

As can be seen from equation (3), the operational amplifier 507 controls the transistor Q based on the sensing signal $V_T$ to regulate the current $I_{LED1}$ flowing through the LED string LED1. As can be seen from equations (1) to (4), when the transistor Q1 operates in the active region, if $I_{OUT}$ increases, $I_{LED1}$ decreases and $I_{LED2}$ increases. If $I_{OUT}$ increases to $I_{T2}$, the operational amplifier 507 turns off the transistor Q1 to turn off the LED string LED1, while the LED string LED2 is still on.

Refer back to FIG. 5. After the power switch 1002 is turned on, during time period T2, the dimming signal SET generated by the dimming unit 301 increases with time, such that the output current $I_{OUT}$ increases with time. If the LED string LED1 generates warm light and the LED string LED2 generates cold light, then during time period T2, the general brightness of the light source module 118 increases, and the color of the light source module 118 transits gradually from warm to cold.

Figure 8:
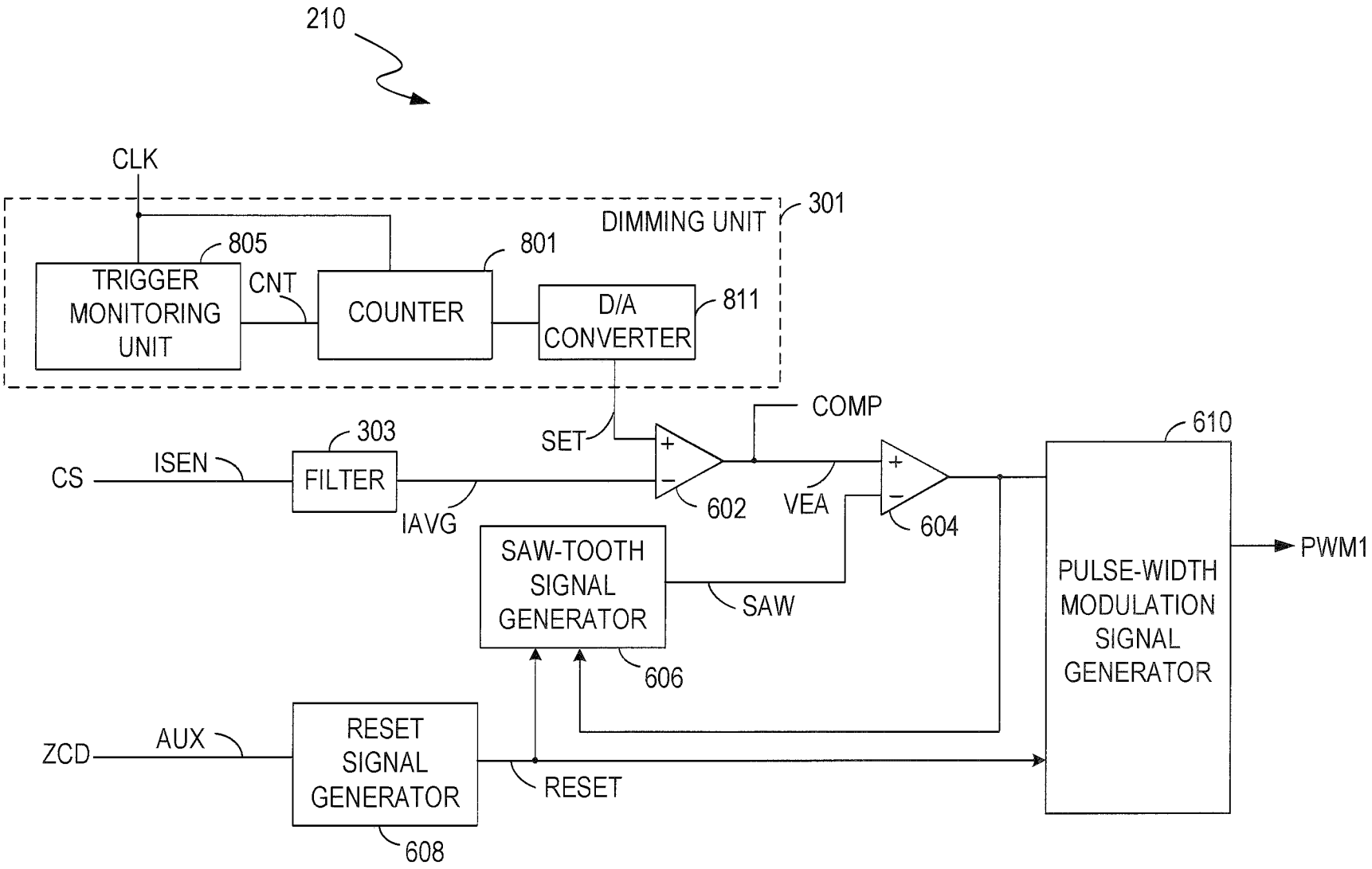
FIG. 8 shows a bock diagram of the controller in FIG. 2, in accordance with another embodiment of the present invention.

FIG. 8 shows a bock diagram of the controller 210 in FIG. 2, in accordance with another embodiment of the present invention. FIG. 8 is similar with FIG. 3 except the configuration of the dimming unit 301. In the example of FIG. 8, the dimming unit 301 includes a trigger monitoring unit 805, a counter 801 and a D/A converter 811. The trigger monitoring unit 805 receives a switch monitoring signal indicating operations of the power switch 1002 via the terminal CLK, and generates a driving signal based on the operations of the power switch 1002. The operations of the switch 1002 include turn-on operations and turn-off operations. Driven by the driving signal, the counter 801 generates a counter value. The D/A converter 811 generates a dimming signal SET based on the counter value. The controller 210 adjusts the output current $I_{OUT}$ based on the dimming signal SET.

Figure 9:
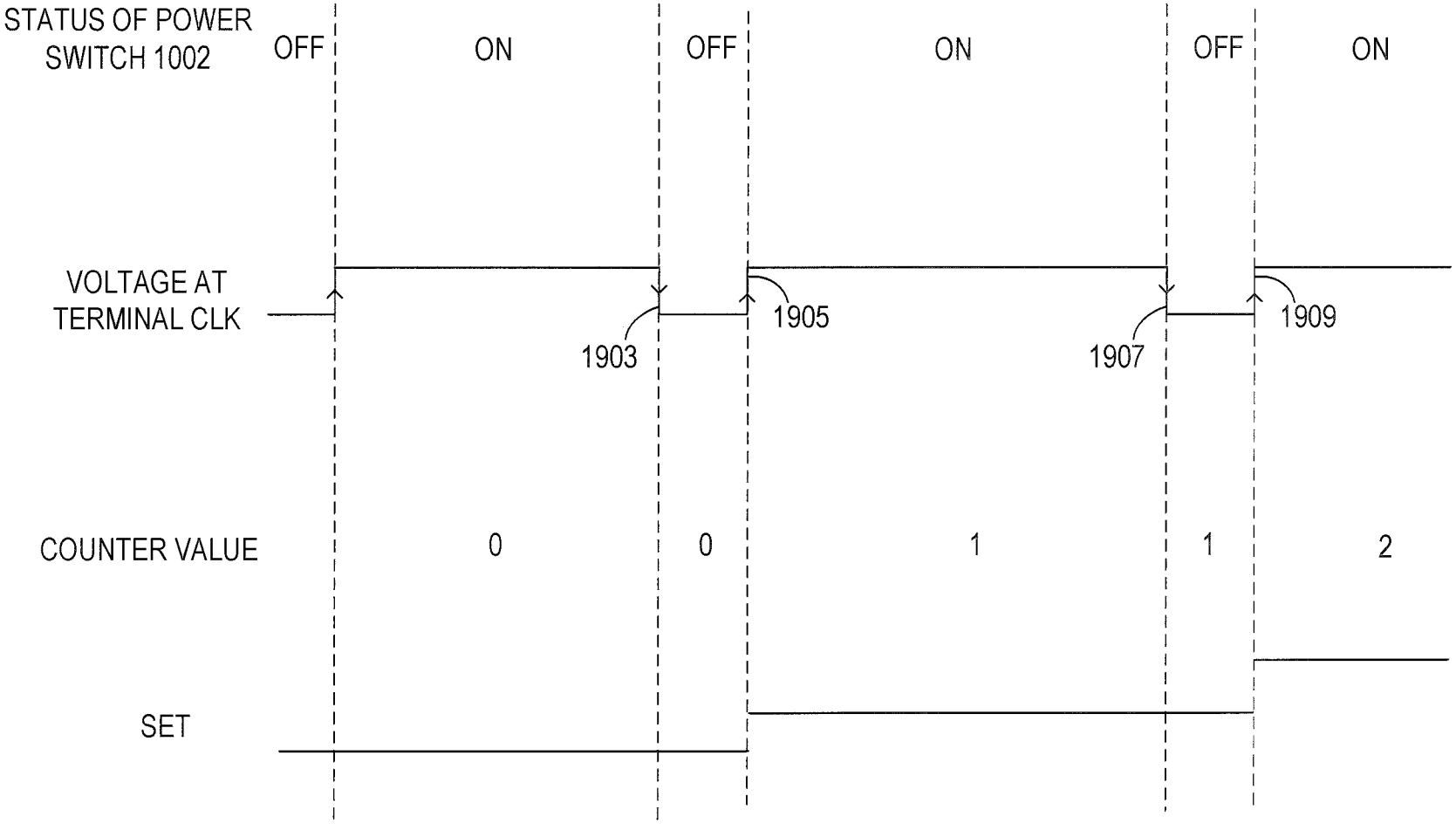
FIG. 9 shows waveforms associated with the light source driving circuit in FIG. 2, in accordance with another embodiment of the present invention.

FIG. 9 shows waveforms associated with the light source driving circuit 200 which adopts the controller 210 in FIG. 8, in accordance with one embodiment of the present invention. FIG. 9 is described in combination with FIG. 8. Assume that the power switch 1002 is initially turned off. When the power switch 1002 is turned on by a user, the power converter 206 powers the light source module 118. The output current $I_{OUT}$ from the power converter 206 is determined by an initial value of the dimming signal SET generated by the D/A converter 811. If the user wants to adjust the brightness and/or the color of the light source module 118, a set of operations can be applied to the power switch 1002. The trigger monitoring unit 805 receives a switch monitoring signal via the terminal CLK. In one embodiment, the set of operations of the power switch 1002 includes a first turn-off operation followed by a first turn-on operation. Accordingly, a negative-going edge 1903 followed by a positive-going edge 1905 (shown in FIG. 9) detected at terminal CLK indicates that the trigger monitoring unit 805 receives the switch monitoring signal. In response to this set of operations, the trigger monitoring unit 805 generates a driving signal CNT to the counter 801 to increase the counter value by 1 (e.g., from 0 to 1). The dimming signal SET from the D/A converter 811 is also adjusted accordingly (e.g, from the initial value to a second value). As a result, the output current $I_{OUT}$ from the power converter 206 is also adjusted. As can be seen from FIG. 7, the brightness and the color of the light source module 118 change with the output current $I_{OUT}$. Similarly, if the user applies another set of operations to the power switch 1002, e.g., a second turn-off operation followed by a second turn-on operation, the trigger monitoring unit 805 detects a negative-going edge 1907 followed by a positive-going edge 1909 at terminal CLK. In response to this set of operations, the trigger monitoring unit 805 generates a driving signal CNT to the counter 801 to increase the counter value by 1 (e.g., from 1 to 2). The dimming signal SET from the D/A converter 811 is adjusted accordingly (e.g, from the second value to a third value). As a result, the brightness and the color of the light source module are changed again.

As described above, the light source driving circuits disclosed in present invention can cooperate with conventional power switches. A user can utilize a conventional on/off switch mounted on the wall to adjust both the brightness and color of the light source, without the need for special dimmer or remote controller.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A light source driving circuit comprising:

a rectifier operable for rectifying a voltage from a power source and providing a rectified voltage;

a power converter, coupled to said rectifier, operable for receiving said rectified voltage and providing an output current; and a light source module, coupled to said power converter and powered by said output current, comprising:

a first light source having a first color;

a second light source having a second color; and a current allocation unit, coupled to said first light source and said second light source, operable for adjusting a current through said first light source and a current through said second light source based on said output current, wherein said current allocation unit comprises:

a sensing unit, coupled to said first light source and said second light source, operable for providing a sensing signal indicating said output current;

a control unit coupled to said sensing unit; and a current regulation unit coupled to said first light source, wherein said control unit is operable for controlling said current regulation unit based on said sensing signal to regulate said current through said first light source, wherein said control unit comprises an operational amplifier, wherein said current regulation unit comprises a second switch coupled in series with said first light source, wherein a first input terminal of said operational amplifier receives a reference signal, a second input terminal of said operational amplifier is coupled to said sensing unit through a second resistor to receive said sensing signal, and an output terminal of said operational amplifier is coupled to said second switch, wherein said operational amplifier is operable for adjusting said current through said first light source by controlling said second switch.

2. The light source driving circuit of claim 1, further comprising:

a controller, coupled to said power converter, operable for monitoring a power switch coupled between said power source and said light source driving circuit, operable for receiving a dimming request signal indicating a first set of operations of said power switch and a dimming termination signal indicating a second set of operations of said power switch, operable for adjusting said output current in response to said dimming request signal, and operable for stop adjusting said output current in response to said dimming termination signal.

3. The light source driving circuit of claim 2, wherein said controller maintains said output current unchanged during a predetermined time period before adjusting said output current.

4. The light source driving circuit of claim 2, wherein said first set of operations of said power switch comprises a first turn-on operation, wherein said second set of operations of said power switch comprises a first turn-off operation followed by a second turn-on operation.

5. The light source driving circuit of claim 2, wherein said controller comprises:

a dimming unit, operable for generating a dimming signal based on said dimming request signal and said dimming termination signal, wherein said controller is operable for adjusting said output current based on said dimming signal.

6. The light source driving circuit of claim 5, wherein said dimming unit comprises:

a trigger monitoring unit, operable for receiving said dimming request signal and said dimming termination signal and generating an enable signal;

a timer, operable for measuring time under control of said enable signal; and a D/A converter, operable for generating said dimming signal based on an output of said timer.

7. The light source driving circuit of claim 5, further comprising:

an energy storage unit coupled between said rectifier and said light source module;

a current sensor coupled to said energy storage unit, operable for generating a first signal indicating an instant current flowing through said energy storage unit; and a filter, coupled to said current sensor, operable for generating a second signal based on said first signal, said second signal indicating an average current flowing through said energy storage unit, wherein said controller is operable for adjusting said output current by controlling a first switch coupled between said rectifier and said energy storage unit.

8. The light source driving circuit of claim 7, wherein said controller further comprises:

a saw-tooth signal generator, operable for generating a saw-tooth signal; and an error amplifier, operable for generating an error signal based on said second signal and said dimming signal, wherein if a voltage of said saw-tooth signal increases to a voltage of said error signal, said controller turns off said first switch.

9. The light source driving circuit of claim 8, wherein said controller further comprises:

a reset signal generator operable for generating a reset signal, wherein said controller turns on said first switch in response to said reset signal.

10. The light source driving circuit of claim 1, further comprising:

a controller, coupled to said power converter, operable for receiving a switch monitoring signal and adjusting said output current based on said switch monitoring signal, wherein said switch monitoring signal indicates a set of operations of a power switch coupled between said power source and said light source driving circuit.

11. The light source driving circuit of claim 10, wherein said output current has a first level after a first turn-on operation of said power switch, wherein if said switch monitoring signal indicates that said set of operations of said power switch comprises a first turn-off operation followed by a second turn-on operation, said controller adjusts said output current from said first level to a second level.

12. The light source driving circuit of claim 10, wherein said controller comprises:

a dimming unit, operable for generating a dimming signal based on said switch monitoring signal, wherein said controller is operable for adjusting said output current based on said dimming signal.

13. The light source driving circuit of claim 12, wherein said dimming unit comprises:

a trigger monitoring unit, operable for receiving said switch monitoring signal and generating a driving signal;

a counter driven by said driving signal, operable for generating a counter value; and a D/A converter, operable for generating said dimming signal based on said counter value.

14. The light source driving circuit of claim 12, further comprising:

an energy storage unit coupled between said rectifier and said light source module;

a current sensor coupled to said energy storage unit, operable for generating a first signal indicating an instant current flowing through said energy storage unit; and a filter, coupled to said current sensor, operable for generating a second signal based on said first signal, said second signal indicating an average current flowing through said energy storage unit, wherein said controller is operable for adjusting said output current by controlling a first switch coupled between said rectifier and said energy storage unit.

15. The light source driving circuit of claim 14, wherein said controller further comprises:

a saw-tooth signal generator, operable for generating a saw-tooth signal; and an error amplifier, operable for generating an error signal based on said second signal and said dimming signal, wherein if a voltage of said saw-tooth signal increases to a voltage of said error signal, said controller turns off said first switch.

16. The light source driving circuit of claim 15, wherein said controller further comprises:

a reset signal generator operable for generating a reset signal, wherein said controller turns on said first switch in response to said reset signal.

17. The light source driving circuit of claim 1, wherein said first light source comprises a first LED string and said second light source comprises a second LED string, wherein a forward voltage of said first LED string is less than a forward voltage of said second LED string.

18. The light source driving circuit of claim 1, wherein said sensing unit comprises:

a first resistor, wherein said current through said first light source and said current through said second light source both flow through said first resistor.

19. A light source module comprising:

a first light source having a first color;

a second light source having a second color; and a current allocation unit, coupled to said first light source and said second light source, operable for adjusting a current through said first light source and a current through said second light source based on an input current of said light source module, wherein said current allocation unit comprises:

a sensing unit, coupled to said first light source and said second light source, operable for providing a sensing signal indicating said input current;

a control unit coupled to said sensing unit; and a current regulation unit coupled to said first light source, wherein said control unit is operable for controlling said current regulation unit based on said sensing signal to regulate said current through said first light source, wherein said control unit comprises an operational amplifier, wherein said current regulation unit comprises a second switch coupled in series with said first light source, wherein a first input terminal of said operational amplifier receives a reference signal, a second input terminal of said operational amplifier is coupled to said sensing unit through a second resistor to receive said sensing signal, and an output terminal of said operational amplifier is coupled to said second switch, wherein said operational amplifier is operable for adjusting said current through said first light source by controlling said second switch.

20. The light source module of claim 19, wherein said first light source comprises a first LED string and said second light source comprises a second LED string, wherein a forward voltage of said first LED string is less than a forward voltage of said second LED string.

21. The light source module of claim 19, wherein said sensing unit comprises:

a first resistor, wherein said current through said first light source and said current through said second light source both flow through said first resistor.

* * * * *